United States Patent [19]

Shiga et al.

[11] Patent Number: 4,794,781

[45] Date of Patent: Jan. 3, 1989

[54] DEFORMATION RESISTANT FRAME FOR A PRESS

[75] Inventors: Masakatsu Shiga, Machida; Yuichi Nakamura, Sagamihara, both of Japan

[73] Assignee: Aida Engineering, Ltd., Sagamihara, Japan

[21] Appl. No.: 101,933

[22] Filed: Sep. 28, 1987

[30] Foreign Application Priority Data

Sep. 29, 1986 [JP] Japan ..... 61-149167[U]
Apr. 10, 1987 [JP] Japan ..... 62-88487

[51] Int. Cl.[4] ..... B21J 13/04
[52] U.S. Cl. ..... 72/455; 100/214
[58] Field of Search ..... 72/455, 456; 100/214

[56] References Cited

U.S. PATENT DOCUMENTS

| | | | |
|---|---|---|---|
| 2,482,346 | 9/1949 | Kinker | 100/214 |
| 3,302,556 | 2/1967 | Durbin | 100/214 |
| 4,309,893 | 1/1982 | Mueller | 72/455 |
| 4,325,298 | 4/1982 | Delmer | 100/214 |

FOREIGN PATENT DOCUMENTS

| | | | |
|---|---|---|---|
| 2652320 | 5/1978 | Fed. Rep. of Germany | 72/455 |
| 872305 | 10/1981 | U.S.S.R. . | |
| 1222573 | 4/1986 | U.S.S.R. . | |

OTHER PUBLICATIONS

"Calculation Elements and Parts and Essential Parts for Crank Press" by Lanskoj E. N., 1966, p. 298.
"Design and Structure of Forging Press Machines" by Baskakoy, S. T., 1963, p. 45, FIG. 10.
"Machine Press" by Shalnev U. G., 1946, pp. 201, 202, FIG. 240.

*Primary Examiner*—David Jones
*Attorney, Agent, or Firm*—Spencer & Frank

[57] ABSTRACT

A frame for a press, including a bed having four corners, upstanding members formed integrally with the bed at its four corners, and bow resisting elements disposed between the bed and the upstanding members so as to resist bowing of the upstanding members under a vertical load on the bed. In one embodiment the bow resisting elements include rib members connected to the bed and extending inside the upstanding members. In another embodiment the bow resisting elements include wedge members wedged between a bolster on the bed and the upstanding members.

9 Claims, 5 Drawing Sheets

DEFORMATION RESISTANT FRAME FOR A PRESS

BACKGROUND OF THE INVENTION

The present invention relates to a frame for a press, and more particularly to a frame which prevents a press bed and columns from deforming under a working load.

A prior art frame for a straight-side press, as shown in FIG. 7, has a frame structure including a bed 1; columns 2 set up in front and rear on both the left and right of the bed 1, that is, on the four corners of the bed; a crown 3 disposed on the columns 2; and tie rods 4 for fastening together the bed 1, the columns 2 and the crown 3. A bolster 5 is mounted on the bed 1 in the center thereof and is bolted to the bed 1, and a slide 6 is so constructed that it can move up and down relative to the bolster 5 within the columns 2.

Pressing is performed between lower and upper dies 7 and 8 respectively provided on the bolster 5 and the slide 6.

When the press is under a working load, the bed 1 and the slide 6 deflect in the vertical direction by distances $\delta_1$ and $\delta_2$, respectively, as shown by dashed line and the columns 2 deform inwardly by a distance $\delta_3$ toward the center of the press under the influence of the deflection of the bed.

The deformation of the bed and columns during the press operation will have the effect of lowering the dynamic accuracy of the press, and particularly the deformation of the columns deforms the guiding surface of the slide, thereby causing the slide movement to devert from its intended path, resulting in a lowering of the accuracy of manufacture of products.

The prior art method of bolting the bolster to the bed does not decrease the deflection of the bed and the deformation of the columns.

SUMMARY OF THE INVENTION

It is an object of the present invention to provide a frame for a press which solves the above-described problems of the prior art and decreases the bed deflection and the column deformation.

According to a first embodiment of the invention, there is provided a frame for a press having upstanding members formed integrally with a press bed on the four corners thereof, columns provided on the upstanding members, a crown provided on the columns, and tie rods fastening these respective parts, the frame comprising rib members connected to the bed and provided inside the upstanding members so as to decrease the bed deflection and the column deformation when the press is under a working load, thereby improving accuracy of operation of the press and the resultant manufacture of products.

According to a second embodiment of the invention, there is provided a frame using the bolster mounted on the bed so as to decrease the bed deflection, in place of the rib members according to the first embodiment. The second embodiment has upstanding members on the four corners of the bed and a pair of wedge members mounted on opposite sides of the bolster positioned on the bed, each between the upstanding members and the bolster, so as to fix the sides of the bolster to the bed in a restrained condition thereagainst.

BRIEF DESCRIPTION OF THE DRAWINGS

These and other features and advantages of the invention will be more completely understood from the following description of the preferred embodiments when considered with the accompanying drawings in which:

FIGS. 1 to 4 illustrate a frame according to a first embodiment of the invention, in which FIG. 1 is a plan view of a bed of the press, FIG. 2 is a sectional view taken on line II—II of FIG. 1, FIG. 3 is a sectional view taken on line III—III of FIG. 1, and FIG. 4 is a front view of the overall press incorporating the structure shown in FIGS. 1-3;

FIGS. 5 and 6 illustrate a frame according to a second embodiment of the invention, in which FIG. 5 is a front view of a bed of the press and FIG. 6 is a detailed view of part A of FIG. 5.

DESCRIPTION OF THE PREFERRED EMBODIMENTS

Figure 1:
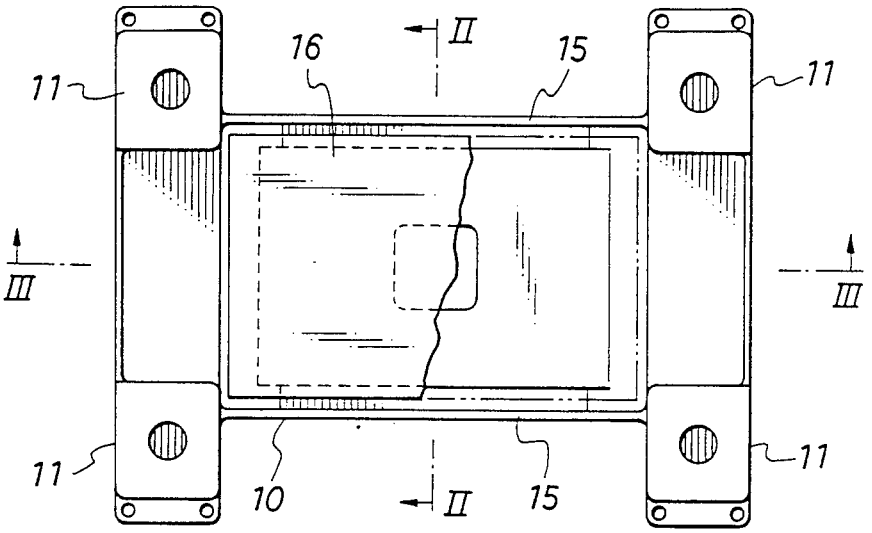
Figure 2:
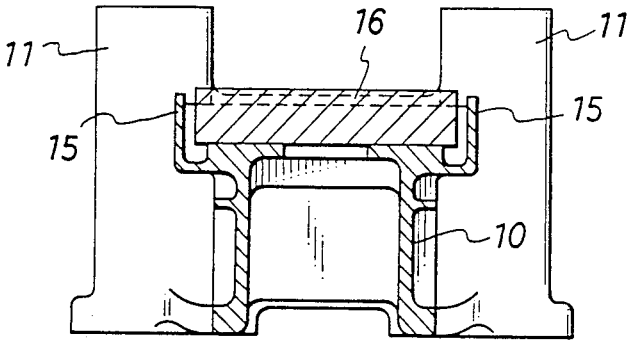
Figure 3:
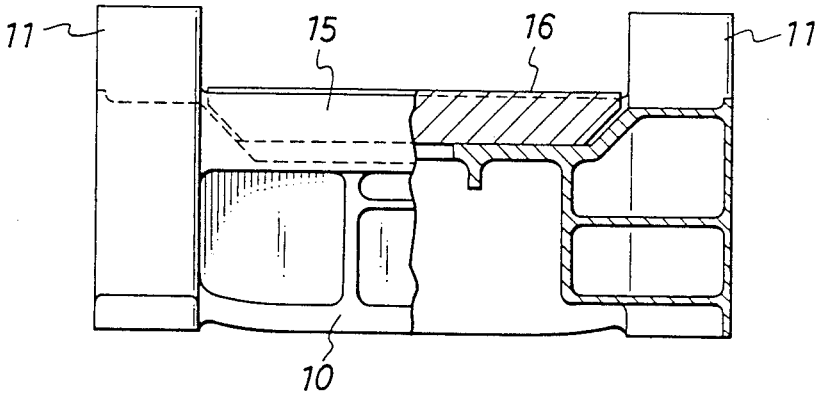
Figure 4:
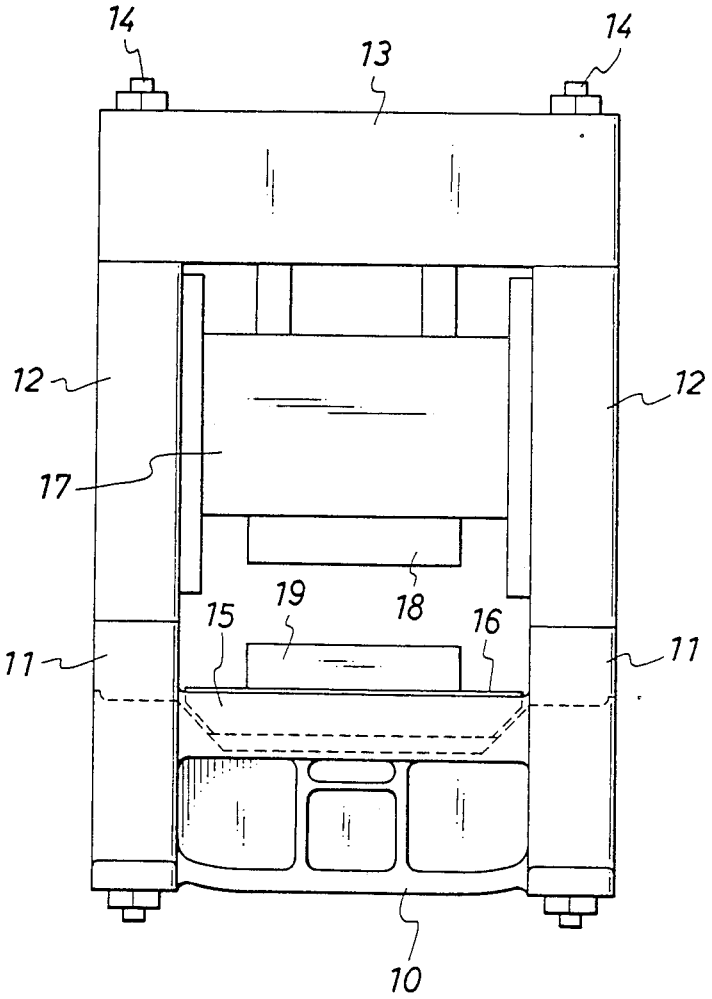

Referring to FIGS. 1 to 4, a press comprises a bed 10 having four corners, upstanding members 11 formed integrally with the bed on the four corners, columns 12 provided on the upstanding members 11 and connected therewith, a crown 13 provided on the columns 12, and tie rods 14 extending through the bed 10, upstanding members 11, columns 12 and crown 13 to fix these parts together.

The upstanding members 11 are provided with rib members 15 in the front and rear of the press. The rib member 15 may be provided where the distance between the upstanding members 11 is longer, and in the embodiment as shown, the rib members 15 are provided in the front and rear which are longer than the sides. Each rib member 15 has an upper portion which is vertically plate-shaped. Further, the lower portion of each rib member 15 is integral with the bed 10.

Positioned on the bed 10 and fixed thereto is a bolster 16. The bolster is normally very heavy and is positioned on the bed 10 with, for example, a fork lift or jack.

The press has a slide 17 which is mounted inside (between), and in sliding engagement with, the columns 12 in a reciprocally vertically movable manner. An upper die 18 is provided on the lower surface of the slide 17 while a lower die 19 is provided on the upper surface of the bolter 16, and between the upper and lower dies 18 and 19, pressing is performed.

When the press of the above structure starts to operate, the working load of the press deflects the bed 10 and at the same time deflects the columns 12 inwardly toward the center of the frame. The rib members 15 mounted to the upstanding members 11, however, prevent the upstanding members 11 and the columns 12 from collapsing inside and accordingly, prevent the deflection of the bed 10, thereby improving the dynamic accuracy of the press.

Figure 7:
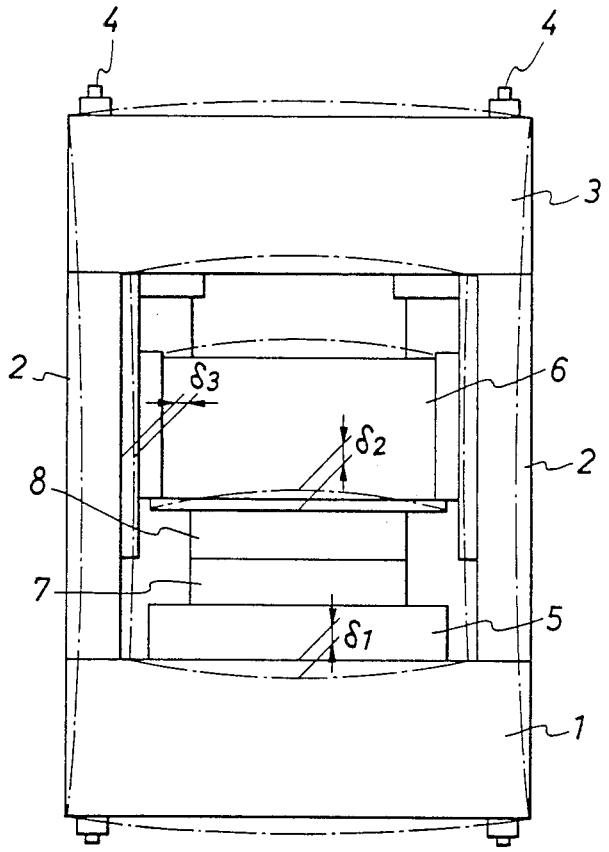
FIG. 7 is a front view of a press of the prior art.

An experiment was performed with a press in accordance with this first embodiment of the invention and a conventional press arrangement to compare their dynamic accuracy. For both the press with the frame of the first embodiment of the invention and a conventional press as illustrated in FIG. 7, two hydraulic jacks were mounted in a double crank press wherein the height between the bed and the lower surface of the crown was 1700 mm, the internal width between the columns was 1600 mm, the height of the bed was 700 mm, and the thickness of the bolster was 180 mm, the hydraulic jacks being 600 mm apart from each other between the slide and the bolster.

For each press arrangement, inward deflection of the middle of the columns was measured in a condition with a 200-ton load applied between the slide and the bolster by causing each of the two hydraulic jacks to generate 100-ton pressure, with the press in a stop condition.

As a result of the experiment, the press with the frame of the invention had a 0.02 mm column deflection under the 200-ton load while the conventional press with the conventional frame had a 0.15 mm column deflection under the same condition.

Figure 5:
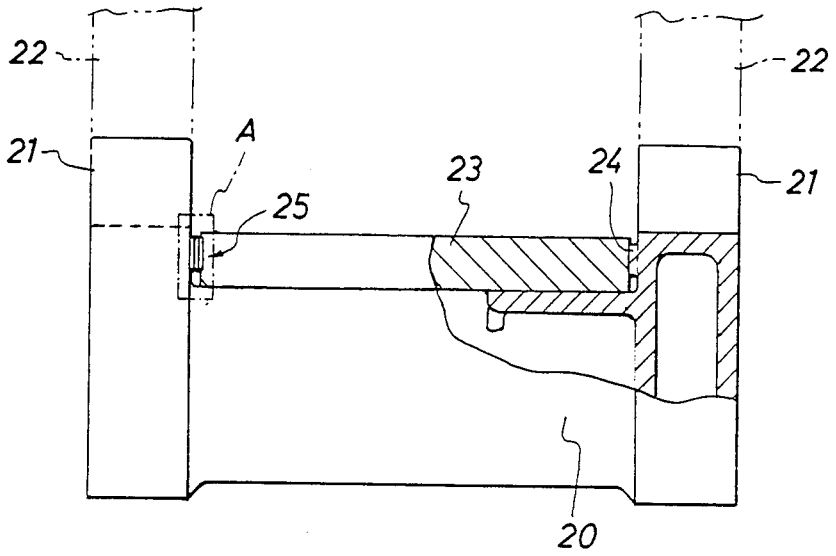
Figure 6:
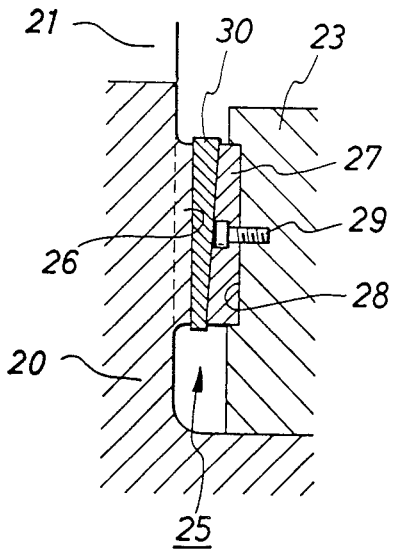

Referring now to FIGS. 5 and 6 illustrating a second embodiment of the press frame of the invention, a bed 20 has a horizontal portion 20*b* upstanding members 21 formed integrally with the horizontal portion 20*b* on the four corners thereof, and columns 22 are provided on the upstanding members 21 and connected therewith. Opposing side walls 20*a* of the bed 20 formed integrally with the horizontal portion 20*b* connect the upstanding members in front to those in the back in FIG. 5. Although the upper part of the columns 22 is omitted for illustration, a crown is positioned on the columns and tie rods are provided to fix the crown, columns and bed, similarly to the first embodiment of the invention described above.

Further, a bolster 23 is positioned on the bed. Between the bolster 23, and the side walls 20*a* and upstanding members 21, there are provided a first wedge member 24 on one side and a second wedge member 25 on the other side.

The first wedge member 24 protrudes from the side wall 20*a* and two upstanding members 21 on the right side (as seen in the front), extending along the entire width in the forward/rearward direction of the bolster 23 and being in contact with the side of the bolster 23. As shown in FIG. 6, a protruding portion 26 constituting the second wedge member 25 protrudes from the left side side wall 20*a* and left side upstanding members 21 of the bed 20, and extends along the entire width in the forward/rearward direction of the bolster 23 at an elevation corresponding to the first wedge member 24. The second wedge member 25 further includes a fixed wedge portion 27 having an inclined surface of which the upper portion is gradually apart from the bed side. The fixed wedge portion 27 is partially fitted in a groove 28 formed on the side of the bolster 23 and is fixed by a mounting bolt 29 so as to form a space between the fixed wedge portion 27 and the protruding portion 26.

Disposed in the space between the protruding portion 26 and the fixed wedge portion 27, is a driving wedge portion 30 which is inclined in a reverse manner to the fixed wedge portion 27. By pushing in the driving wedge portions 30 downward, the left and right sides of the bolster 23 is restrained against the side walls 20*a* and lower portions of the upstanding members 21.

Further, thus restrained bolster 23 is fixed by bolting to the bed 20.

During operation of a press with such a frame, a force is applied to the bed 20 in the direction of deflecting it when the press starts to operate and is put under working load, but the side walls 20*a* and adjacent lower portions of the upstanding members 21 of the bed 20 are supporting the bolster by means of the first and second wedge members 24 and 25, thereby decreasing the deflection of the bed 20 under the working load of the press. With the decrease in the deflection of the bed 20, there will be also a decrease in the accompanying deformation of the upstanding members 21 and columns 22. Consequently, the accuracy of the press can be improved.

The invention now being fully described, it will be apparent to one of ordinary skill in the art that many changes and modifications can be made thereto without departing from the spirit or scope of the invention as set forth herein.

What is claimed is:

1. A frame for a press, comprising:

a horizontal bed having four corners in a plane; and means for supporting said bed, said supporting means including four vertically upstanding support members formed integrally with said bed at said four corners, and rib members formed integrally with said bed and horizontally extending between, and being connected to said upstanding members, said rib members each having a vertical plate-shaped first portion having a greater vertical height than a horizontal thickness and being connected to said upstanding members and a second portion connecting said first portion to said bed, said first portion projecting vertically with respect to said second portion and substantially surrounds said bed.

2. A frame as in claim 1, wherein said frame has a front, a rear opposite said front and opposite sides between said front and rear, said rib members being provided on said front and rear.

3. A frame as in claim 2, wherein said front and said rear are longer than said sides.

4. A frame as in claim 1, further comprising a slide reciprocally vertically slidably movable on said four upstanding members in a space between said four upstanding members, toward and away from said bed.

5. A press device, comprising:

a bed formed in a horizontal plane and having a plurality of corners;

means for supporting said bed, said supporting means including a plurality of elongated support members extending perpendicularly to said plane, one at and formed integrally with each of said corners;

rib members formed integrally with said bed and horizontally extending between and being connected to said support members, said rib members each having a vertical plate-shaped first portion having greater vertical height than horizontal thickness and being connected to said upstanding members, and a second portion connecting said first portion to said bed the first portions projecting vertically with respect to said second portion and substantially surrounding said bed;

a bolster disposed on said bed; and a slide slidably movable in a space between said support members, toward and away from said bolster.

6. A press device as in claim 5, further comprising upper and lower dies respectively disposed on said slide and a bolster so as to press against one another when said slide is moved toward said bolster.

7. A frame for a press, comprising:

a bolster;

a bed, said bed including a horizontal portion having four corners, and four upstanding support members extending in a vertical direction above and below said horizontal portion and formed integrally with said horizontal portion at said four corners, said horizontal portion supporting said bolster thereon, said upstanding support members supporting said horizontal portion and said bolster; and first and second wedge members disposed between said upstanding members and said bolster so as to resist bowing of said upstanding members, said second wedge member including a first wedge portion having first and second inclined surfaces converging toward each other in said vertical direction so as to provide a wedging action between said bolster and said upstanding members.

8. A frame for a press, as in claim 7, wherein said second wedge member further comprises a second wedge portion fixed to one of said bolster and said upstanding members and having a third inclined surface inclined to said vertical direction, said first wedge portion being forcedly wedged downward between said third surface and the other of said bolster and said upstanding members.

9. A frame for a press, as in claim 8, wherein said second wedge portion is fixed to said bolster.

* * * * *